US012458896B1

(12) United States Patent
Xu

(10) Patent No.: US 12,458,896 B1
(45) Date of Patent: Nov. 4, 2025

(54) SENSORY INTEGRATION CAROUSEL

(71) Applicant: Zhejiang Tongxi Education Technology Co., LTD, Wenzhou (CN)

(72) Inventor: Dexiao Xu, Wenzhou (CN)

( * ) Notice: Subject to any disclaimer, the term of this patent is extended or adjusted under 35 U.S.C. 154(b) by 1 day.

(21) Appl. No.: 18/920,892

(22) Filed: Oct. 19, 2024

(30) Foreign Application Priority Data

Sep. 18, 2024 (CN) ..... 202411300966.7

(51) Int. Cl.
*A63G 1/12* (2006.01)
*A63G 19/00* (2006.01)

(52) U.S. Cl.
CPC ..... *A63G 1/12* (2013.01); *A63G 19/00* (2013.01)

(58) Field of Classification Search
CPC ..... A63G 1/12; A63G 19/00; A63G 1/14
See application file for complete search history.

(56) References Cited

U.S. PATENT DOCUMENTS 3,462,140 A * 8/1969 Halaj ..... A63G 1/12 D21/830
3,649,007 A * 3/1972 Thomas ..... A63G 23/00 472/135
9,868,070 B2 * 1/2018 Bentsen ..... A63B 23/0205
2013/0045810 A1 * 2/2013 Keller ..... A63G 1/14 472/29

* cited by examiner

*Primary Examiner* — Michael D Dennis
(74) *Attorney, Agent, or Firm* — Shen Huang

(57) ABSTRACT

The present disclosure discloses a sensory integration carousel for a child, including a base unit and a carousel unit, and the base unit includes a base structure and a mounting structure, and the mounting structure includes a mounting channel, a mounting support component and a connecting channel; the carousel unit includes a carrying structure and a connecting structure, the carrying structure is connected with the connecting structure as an integrated structure, and a carrying portion is disposed at an upper portion of the carrying structure; the connecting structure includes a supporting member wrapped by a lower part of the carrying structure and a connecting member connected to the supporting member, wherein, a lower part of the connecting member is disposed as a rotation shaft, and the rotation shaft is embedded in the connecting channel and connected to the base unit, and the carousel unit is arranged at an angle to the support interface of the base unit after the carousel unit is connected to the base unit via the rotation shaft, and the carousel unit is rotatably disposed along an axial direction of the rotation shaft via the rotation shaft relative to the base unit. The sensory integration carousel for a child structure has a simple and solid structure and is very safe, thereby making it ideal for children.

16 Claims, 7 Drawing Sheets

SENSORY INTEGRATION CAROUSEL

FIELD OF THE INVENTION

The present disclosure relates to a field of sensory integration toys, and in particular to, a sensory integration carousel for a child.

BACKGROUND OF THE INVENTION

When a child's sensory integration capability is insufficient or dysfunctional, it may affect a coordinated operation of functional regions of the brain, sensory organs and the body, thereby in turn causing problems in learning and life, etc. Sensory integration toys are a kind of training tool that can provide sensory stimulation and interactive experience, which can help children exercise, and improve their sensory integration capability during play, so as to promote their healthy growth.

Sensory integration carousel is a sensory integration toy for children to ride on the carousel to rotate their body to experience a rotating sensation. Most of the sensory integration carousels on the market nowadays are composed of three parts of a carousel, a base, and a connecting member. The base is used for placing on the ground. An upper end of the connecting member is detachably connected to the carousel. A lower end of the connecting member is detachably connected to the base, and it can be rotated and connected, so that the carousel can be driven to rotate with respect to the base and the ground. And the connecting member of this technical solution is mainly connected with the carousel via a screw, which is prone to loosening and falling off after a long time of use, leading to a risk of children such as tipping over and slipping during using and rotating the sensory integration carousel, and the safety is low.

SUMMARY

The present disclosure provides a sensory integration carousel for a child for the shortcomings in the prior art, and solves the technical problems of unstable connection and low safety between the connecting member and the carousel in the prior art.

The present disclosure provides a sensory integration carousel for a child provided by the present disclosure, includes a base unit and a carousel unit. The base unit includes a base structure for placing on a support countertop surface and a mounting structure provided in an upper part of the base structure. Wherein, a support interface is formed at a lower part of the base structure and in a circumferential direction for pressed against the support table surface. And an outer surface of the base structure is provided in an arc shape in a direction to a bottom of the base structure from a top of the base structure. The mounting structure includes a mounting channel through the base structure, a mounting support component disposed within the mounting channel, and a connecting channel disposed along a center of the mounting support component and through the base structure. The carousel unit includes a carrying structure and a connecting structure connected to a lower portion of the carrying structure. Wherein, the carrying structure is connected with the connecting structure as an integrated structure. And a carrying portion is disposed at an upper portion of the carrying structure for articles for pressed against and in an arc surface. The connecting structure includes a supporting member wrapped by a lower part of the carrying structure and a connecting member connected to the supporting member. Wherein, a lower part of the connecting member is disposed as a rotation shaft. And the rotation shaft is embedded in the connecting channel and connected to the base unit. And the carousel unit is arranged at an angle to the support interface of the base unit after the carousel unit is connected to the base unit via the rotation shaft. And the carousel unit is rotatably disposed along an axial direction of the rotation shaft via the rotation shaft relative to the base unit.

The sensory integration carousel for a child provided by the present disclosure, includes a base unit and a carousel unit. The carousel unit includes a carrying structure and a connecting structure connected to a lower portion of the carrying structure. The carrying structure and the connecting structure are processed and connected as an integrated structure during production, and the connection is stable and reliable. And the supporting member of the connecting structure is wrapped by a lower part of the carrying structure, so that the supporting member of the connecting structure is firmly wrapped and fixed within lower part of the carrying structure, and the connecting structure will not fall off from the carrying structure, thus greatly improving the stability and reliability of the connection between the connecting structure and the carrying structure, and providing higher safety in the process of sensory integration training for children, and is more suitable for sensory integration training for children. And the connecting member and the supporting member form an integrated structure, therefore, it is not necessary to provide additional screws for connection, and the structure is simplified. The carousel unit is arranged at an angle relative to the support interface of the base unit, after the carousel unit is connected with the base unit via the rotation shaft. And the carousel unit is rotatably disposed along an axial direction of the rotation shaft via the rotation shaft relative to the base unit, thereby making rotating process of the carousel unit has a high and low difference, when the children ride in the carousel unit to rotate the body, the children not only can experience the feeling of the horizontal rotation, but also can experience the feeling of the rise and fall, the sensory stimulation of children is more comprehensive and increase the fun of play, can stimulate the interest of children in sensory integration training. A carrying portion is provide at an upper part of the carrying structure for a human's buttocks, legs or other toys and other items to rest against, and is in an arc shape, so as to allow children to ride on the carrying portion to rotate, or place various toys to rotate on the carrying portion to play. The carrying portion is configured as an arc shaped surface, and is more in line with the structure of the human body. The stability for the children to ride on the carrying portion is better, and the children are not easy to rotate outside the rotating carousel unit under the centrifugal force. This further improves the safety of sensory integration training process for children. The support interface is arranged along a circumferential direction of a lower part of the base structure, which can support the pressure force exerted at various angles during the rotation of the carousel unit in 360° directions. And an outer surface of the base structure is disposed in an arc shape in the direction to a bottom of the base structure from a top of the base structure, so that during the rotation of the carousel unit, the pressure forces on the various parts of the base unit are relatively uniform, so that the structure is stable and strong, and not easy to be damaged, and the safety of sensory integration training process for the children is further improved.

Additional aspects and advantages of the present disclosure will be given, in part, a part will become apparent from the following description, or will be learned through a practice of the present disclosure.

BRIEF DESCRIPTION OF DRAWINGS

The accompanying drawings illustrated herein are used to provide a further understanding of the present disclosure, and form a part of the present disclosure, and the schematic embodiments of the present disclosure and their description are used to explain the present disclosure, and do not constitute an improper limitation of the present disclosure. In the accompanying drawings.

Figure 1:
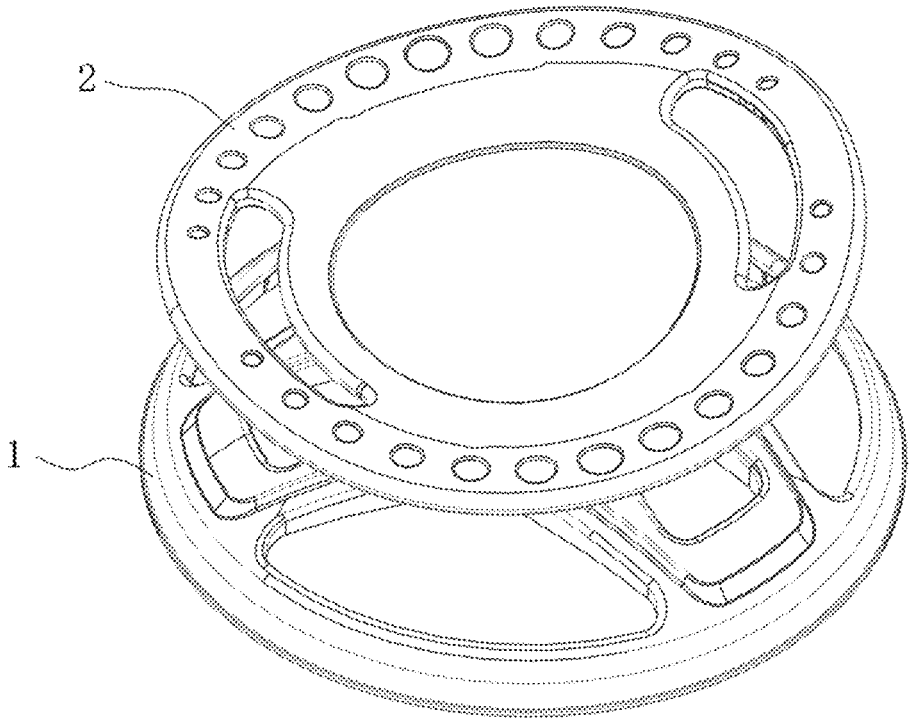
FIG. 1 illustrates a schematic diagram of a structure of a sensory integration carousel for a child according to the first embodiment of the present disclosure.

Reference signs: 1—base unit, 10—support interface, 11—base structure, 111—base frame, 112—mounting plate, 1121—mounting base, 113—base plate, 1130—open-worked structure, 1131—first open-worked channel, 1132—second open-worked channel, 1133—base member, 11331—base portion, 114—second support components, 12—mounting structure, 110—mounting channel, 1101—upper opening, 1102—lower opening, 120—connecting channel, 121—mounting support component, 1211—bearing, 2—carousel unit, 21—carrying structure, 211—carrying plate, 2111—carrying portion, 2112—grip member, 2113—external flange, 2114—positioning pillar, 2115—grip channel, 212—first support components, 213—wrapping region, 2131—first region, 2132—second region, 2133—third region, 214—first limit member, 215—second limit member, 22—connecting structure, 221—supporting member, 2211—positioning channel, 222—connecting member, 2221—connecting shaft, 2222—rotation shaft, 2223—connecting plate, 22231—reinforced column, 2224—limit bracket, 2225—butt joint portion, 223—fastening structure, 2231—fastener, 22311—connecting end, 22312—operating end, 2232—limit stop.

DETAILED DESCRIPTION OF THE EMBODIMENTS

In order to make the objects, technical solutions and advantages of the embodiments of the present disclosure clearer, the technical solutions of the embodiments of the present disclosure will be described clearly and completely in the following in combination with the accompanying drawings of the embodiments of the present disclosure.

As shown in FIGS. 1-8, a first embodiment of the present disclosure provides a sensory integration carousel for a child, including a base unit 1 and a carousel unit 2. The base unit I includes a base structure 11 for placing on a support countertop surface such as ground, floor surfaces, and a mounting structure 12 provided in an upper part of the base structure 11. Wherein, a support interface 10 is formed at a lower part of the base structure 11 and in a circumferential direction for pressed against the support table surface. The mounting structure 12 includes a mounting channel 110 through the base structure 11, a mounting support component 121 disposed within the mounting channel 110, and a connecting channel 120 disposed along a center of the mounting support component 121 and through the base structure 11. The carousel unit 2 includes a carrying structure 21 and a connecting structure 22 connected to a lower portion of the carrying structure 21. Wherein, the carrying structure is connected with the connecting structure as an integrated structure. The connecting structure 22 includes a supporting member 221 wrapped by a lower part of the carrying structure 21 and a connecting member 222 connected to the supporting member 221. Wherein, a lower part of the connecting member 222 is disposed as a rotation shaft 2222. And the rotation shaft 2222 is embedded in the connecting channel 120 and connected to the base unit 1, so that the carousel unit 2 is driven to rotate and move relative to the base unit 1. The sensory integration carousel according to the present embodiment, includes a base unit 1 and a carousel unit 2. The carousel unit 2 includes a carrying structure 21 and a connecting structure 22 connected to a lower portion of the carrying structure 21. The carrying structure 21 and the connecting structure 22 are processed and connected as an integrated structure during production, and the connection is stable and reliable. And the supporting member 221 of the connecting structure 22 is wrapped by a lower part of the carrying structure 21, so that the supporting member 221 of the connecting structure 22 is firmly wrapped and fixed within lower part of the carrying structure 21, and the connecting structure 22 will not fall off from the carrying structure 21, thus greatly improving the stability and reliability of the connection between the connecting structure 22 and the carrying structure 21, and providing higher safety in the process of sensory integration training for children, and is more suitable for sensory integration training for children. And the connecting member 222 and the supporting member 221 form an integrated structure, therefore, it is not necessary to provide additional screws for connection, and the structure is simplified. The carousel unit 2 is arranged at an angle relative to the support interface 10 of the base unit 1, after the carousel unit 2 is connected with the base unit 1 via the rotation shaft 2222. And the carousel unit 2 is rotatably disposed along an axial direction of the rotation shaft 2222 via the rotation shaft 2222 relative to the base unit 1, thereby making rotating process of the carousel unit 2 has a high and low difference, when the children ride in the carousel unit 2 to rotate the body, the children not only can experience the feeling of the horizontal rotation, but also can experience the feeling of the rise and fall, the sensory stimulation of children is more comprehensive and increase the fun of play, can stimulate the interest of children in sensory integration training. A carrying portion 2111 is provide at an upper part of the carrying structure 21 for a human's buttocks, legs or other toys and other items to rest against, and is in an arc shape, so as to allow children to ride on the carrying portion 2111 to rotate, or place various toys to rotate on the carrying portion 2111 to play. The carrying portion 2111 is configured as an arc shaped surface, and is more in line with the structure of the human body. The stability for the children to ride on the carrying portion 2111 is better, and the children are not easy to rotate outside the rotating carousel unit 2 under the centrifugal force. This further improves the safety of sensory integration training process for children. The support interface 10 is arranged along a circumferential direction of a lower part of the base structure 11, which can support the pressure force exerted at various angles during the rotation of the carousel unit 2 in 360° directions. And an outer surface of the base structure 11 is disposed in an arc shape in the direction to a bottom of the base structure from a top of the base structure, so that during the rotation of the carousel unit 2, the pressure forces on the various parts of the base unit I are relatively uniform, so that the structure is stable and strong, and not easy to be damaged, and the safety of sensory integration training process for the children is further improved.

Figure 2:
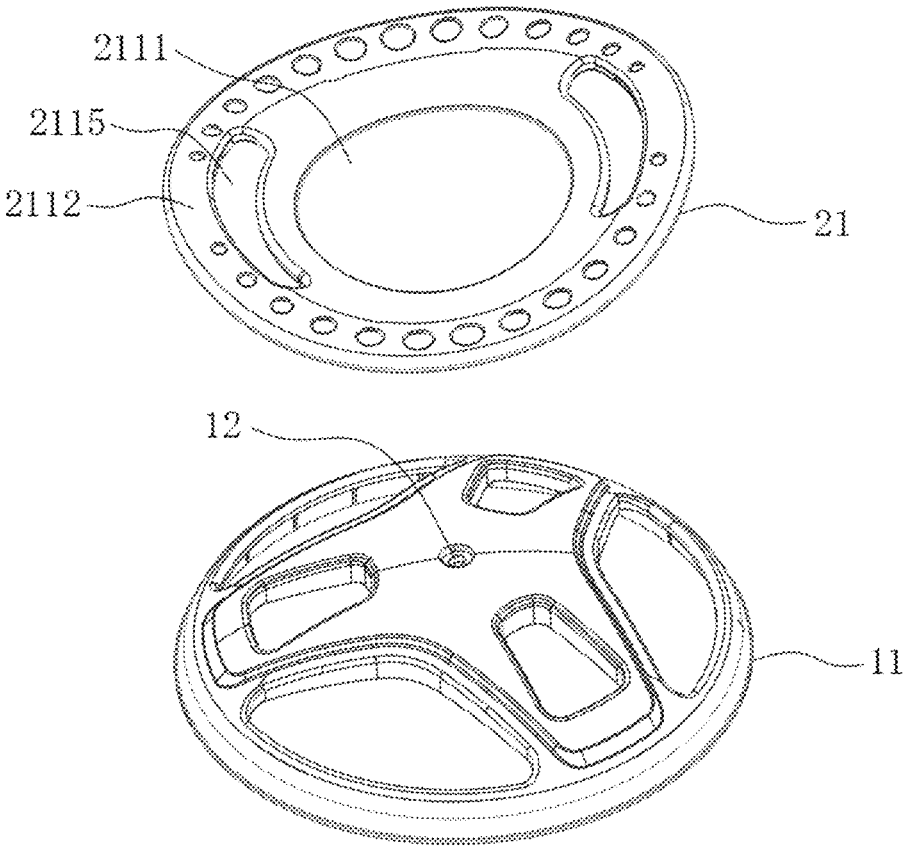
FIG. 2 illustrates a schematic diagram of a structural decomposition of the sensory integration carousel for the child according to the first embodiment of the present disclosure.

As shown in FIG. 2, the carrying structure 21 includes a carrying plate 211 and a grip member 2112 disposed on the carrying plate 211 for gripping when the carrying structure 21 is driven to rotate, and the carrying portion 2111 is configured as a panel structure formed in a circumferential direction from an upper surface of the carrying plate 211, so that the child can further be prevented from flying out of the carousel unit 2 under the centrifugal force of the rotation by gripping the grip member 2112 with the hands, when a child rides on the carrying portion 2111 and rotates, which further improves the safety of the child in the process of sensory integration training for children, and the grip member 2112 includes a portion of the external flange of the carrying portion 2111, thereby simplifying the structure. And in other embodiments, the grip member 2112 can be set up as a stand-alone structure connected to the carrying portion 2111, which can be used for the child's grip in the process of the child's rotation as well.

Figure 3:
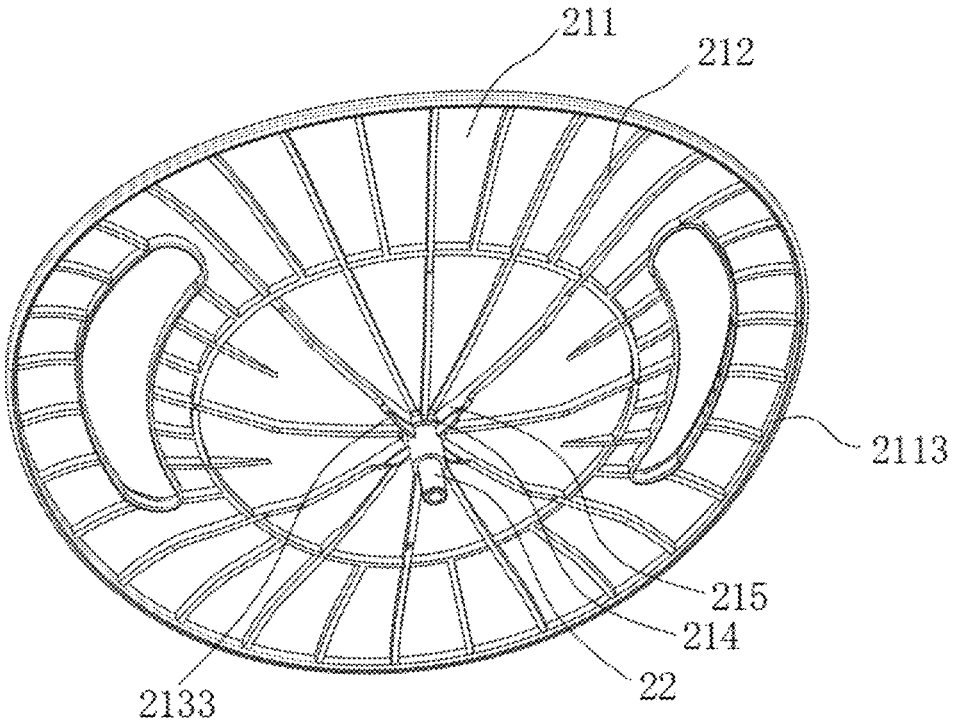
FIG. 3 illustrates a schematic diagram of a structure of a carousel unit according to the first embodiment of the present disclosure.

As shown in FIG. 3, in some specific embodiments, a plurality of first support components 212 for providing a support force are provided at a lower portion of the carrying plate 211. And the first support components 212 are provided as a block-like structure spaced at an interval and arranged linearly along a lower surface of the carrying plate 211 and protruding out from a bottom end surface of the carrying plate 211. The carrying structure 21 is made of plastic material, which is processed and molded by production processes such as injection molding, and blow molding to facilitate mass production. And the first support components 212 are used to strengthen the structural strength of the carrying plate 211, and to improve the stability and carrying capacity of the carrying structure 21 for supporting children. In other embodiments, the first support components 212 may not be provided either, and the carrying structure 21 may be made of other materials such as metal, wood, or the like.

In some specific embodiments, there are a number of first support components 212, wherein a part of the first support components 212 is provided in a strip-like structure and arranged in a clockwise direction with the center of the carrying plate 211, which can provide a direct and strong support for the pressure force exerted on the carrying plate 211 at various angles when a child rides on the carrying portion 2111 to avoid breakage of the carrying plate 211. And one first support components 212 is provided in a circular structure and arranged coaxially with the connecting shaft 2221, and the radius of the one first support components 212 is provided to be greater than the radius of the connecting shaft 2221. Wherein a portion of the first support components 212 in a strip-like structure are arranged on an outer side of the first support components 212 in the circular structure. And one end of the first support components 212 is combined with the external flange 2113, and the other end of the first support components 212 is combined with the first support components 212 of the circular structure. And wherein another portion of the first support components 212 in the strip-like structure are arranged on an inner side of the first support components 212 of the circular structure; one end of the another portion of the first support components 212 is combined with the first limit member 214; and the other end of the another portion of the first support components 212 is combined with the first support components 212 of the circular structure, so as to make the structure of the carrying structure 21 more stable and sturdy. In other embodiments, this first support components 212 may also be provided with other shaped structures such as a curved structure, all of which can be used to strengthen the structural strength of the carrying plate 211.

Figure 7:
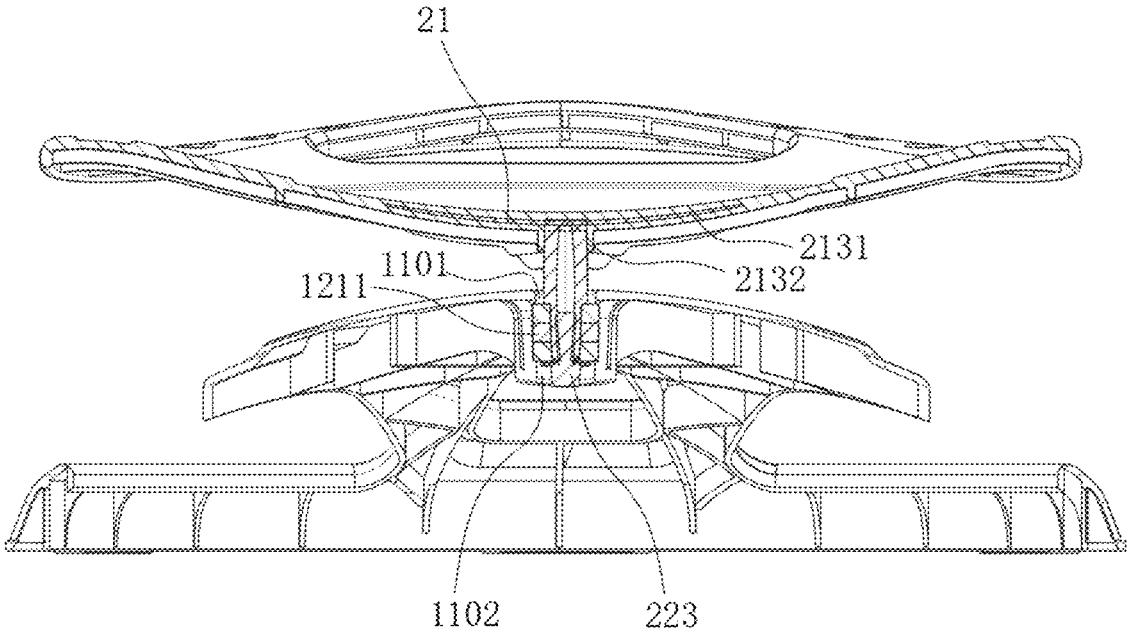
FIG. 7 illustrates a schematic diagram I of a cross-sectional structure of the sensory integration carousel for the child according to the first embodiment of the present disclosure.
Figure 8:
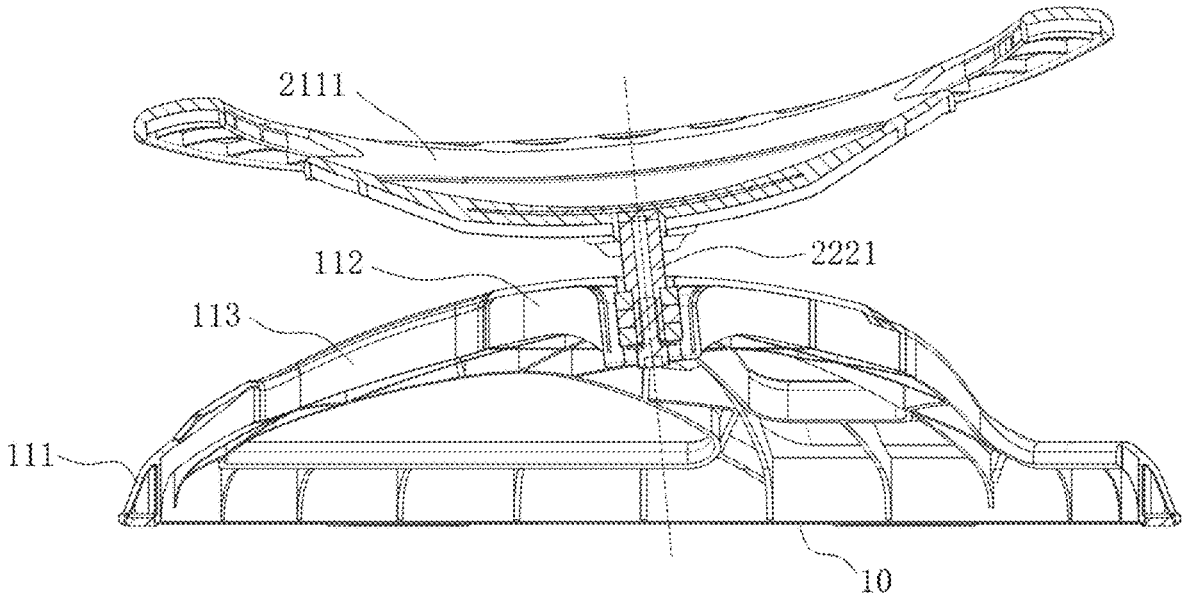
FIG. 8 illustrates a schematic diagram II of a cross-sectional structure of the sensory integration carousel for the child according to the first embodiment of the present disclosure.

As shown in FIGS. 3, 7-8, in some specific embodiments, the carrying plate 211 has an external flange 2113. The external flange 2113 is provided as bosses distributed along an outer circumference of the carrying plate 211 and formed by extending in a direction toward a bottom of the carrying portion 2111 from an upper surface of the carrying portion 2111. And when the carousel unit 2 is rotated with respect to the base unit 1 via the rotation shaft 2222, the curved surface from the highest point of the carrying portion 2111 to the center of the carrying portion 2111 is configured at an M angle to the support interface 10, which is consistent with the structure of the human body, so that a child is capable to place his or her calf against the external flange 2113 when the child rides on the carrying portion 2111, and the calf is in face-to-face contact with the external flange 2113 to avoid scraping the leg, which improves the comfort of the child riding on the carrying portion 2111. An end portion of the first support components 212 is combined with an inner surface of a portion of the external flange of the carrying plate 211, which can strengthen the structural strength of the external flange 2113, improve the stability and load carrying capacity of the external flange 2113 for supporting the child, and prevent the external flange 2113 from fracturing, that is, strengthen the structural strength of an outer periphery of the carrying plate 211, and prevent an outer peripheral structure of the carrying plate 211 from fracturing, thereby further improving the overall structural strength of the carrying structure 21.

In some specific embodiments, the connecting structure 22 is made of metal material such as iron and aluminum, structurally stable and sturdy, making the overall structure of the carousel unit 2 with high stability and high carrying capacity. As shown in FIGS. 7 and 8, an upper portion of the connecting structure 22 is completely covered by a lower structure of the carrying structure 21, which can fully wrap and fix an upper portion of the connecting structure 22, and improve the stability of the connection of the connecting structure 22 with the carrying structure 21. And in some other embodiments, an upper portion of the connecting structure 22 can also be disposed as partially covered by a lower structure of the carrying structure 21, which can also firmly wrap and fix the upper portion of the connecting structure 22 within a lower structure of the carrying structure 21.

Figure 4:
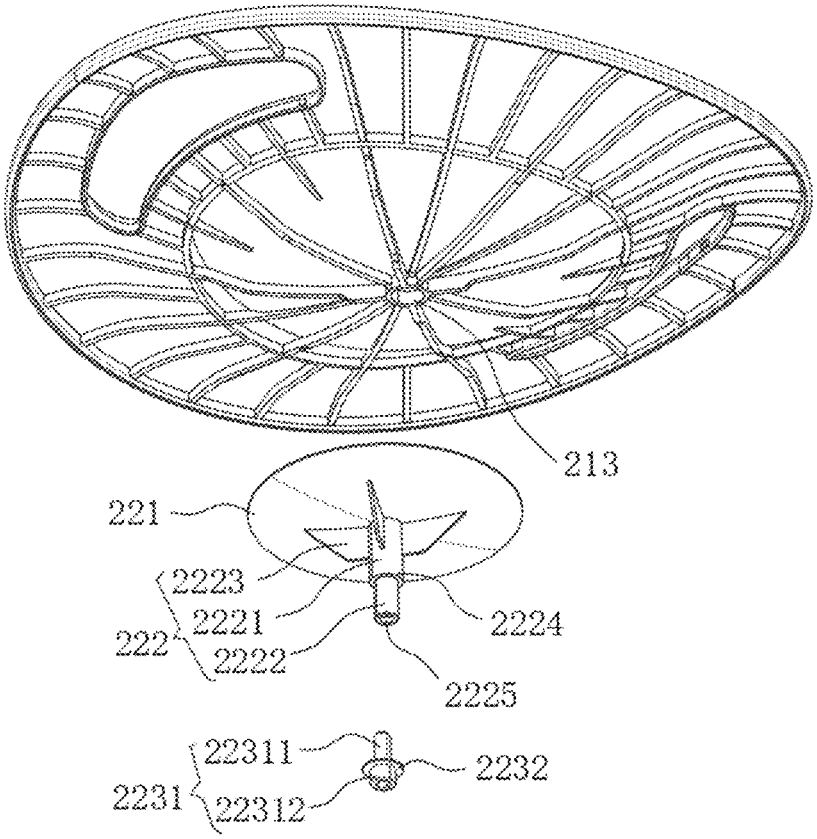
FIG. 4 illustrates a schematic diagram of a structural decomposition of the carousel unit according to the first embodiment of the present disclosure.

As shown in FIG. 4, in some specific embodiments, a wrapping region 213 is provided in a lower portion of the carrying structure 21, and the supporting member 221 is located within the wrapping region 213 and covered by an outer end surface of the carrying structure 21, which can limit the supporting member 221 within the carrying structure 21 along the axial direction of the rotation shaft 2222, and prevent the connecting structure 22 from moving relative to the carrying structure 21 along the axial direction of the rotation shaft 2222, and prevent the connecting structure 22 from falling off from the carrying structure 21.

As shown in FIG. 4, in some specific embodiments, the connecting member 222 includes a connecting shaft 2221 connected to the supporting member 221. And a lower portion of the connecting shaft 2221 forms the rotation shaft 2222. And a connecting plate 2223 protrudes outwardly at an upper portion of the connecting shaft 2221 and is arranged in a length direction of the connecting shaft 2221. And a part of the structure of an upper portion of the connecting shaft 2221 and the connecting plate 2223 is located within the wrapping region 213 and covered by an outer end surface of the carrying structure 21, capable of limiting the connecting plate 2223 within the carrying structure 21 along a circumferential direction of the rotation shaft 2222, avoiding movement of the connecting structure 22 relative to the carrying structure 21 along a circumferential direction of the rotation shaft 2222, and preventing rotation of the connecting structure 22 relative to the carrying structure 21.

In some specific embodiments, the supporting member 221 is provided as a panel structure corresponding to an arrangement direction of the carrying portion 2111, which has a larger contact region with the carrying structure 21, and is more capable of avoiding axial movement of the connecting structure 22 relative to the carrying structure 21 along the rotation shaft 2222, and more capable of preventing the connecting structure 22 from falling off from the carrying structure 21. In this embodiment, the supporting member 221 is provided as a circular disk structure, and the structure is simple. And in other embodiments the supporting member 221 may also be provided as other shaped structures such as a square disk structure, and a pentagram structure. A number of connecting plates 2223 are spaced at an interval and arranged along a circumferential direction of the connecting shaft 2221, and have a larger contact region with the carrying structure 21, is more capable of avoiding circumferential movement of the connecting structure 22 relative to the carrying structure 21 along the rotation shaft 2222, and is more capable of preventing the connecting structure 22 from rotating relative to the carrying structure 21. Each connecting plate 2223 is arranged radially along the connecting shaft 2221 respectively, and is vertically connected to a lower surface of the supporting member 221, so that the connecting plate 2223 forms a triangular support structure between the connecting shaft 2221 and the supporting member 221, which can strengthen the stability and the load carrying capacity of the structure of the supporting member 221, thereby strengthening the stability and load carrying capacity of the overall structure of the carousel unit 2, and is more conducive to avoiding circumferential movement of the connecting structure 22 relative to the carrying structure 21 along the rotation shaft 2222. Of course, in some other embodiments, the supporting member 221 may also be provided with other structures such as a rod structure; and there may be only one the connecting plate 2223; and the connecting plate 2223 may further be arranged at an inclined angle to a radial direction of the connecting shaft 2221, or may further be arranged at an inclined angle a lower surface of the supporting member 221; all of these embodiments realizes mutual positioning of the connecting structure 22 and the carrying structure 21.

As shown in FIG. 3, in some specific embodiments, the carrying structure 21 further includes a first limit member 214 protruding from a lower surface of the carrying plate 211 and arranged in correspondence with an upper portion of the connecting shaft 2221, and a second limit member 215 protruding from a lower surface of the carrying plate 211 and arranged in correspondence with the connecting plate 2223. As shown in FIGS. 7, 8, the wrapping region 213 includes a first region 2131 provided within a lower structure of the carrying plate 211, a second region 2132 provided within the first limit member 214, and a third region 2133 provided within the second limit member 215. The supporting member 221 is wrapped within the first region 2131 and covered by an outer end surface of the carrying plate 211. And a top surface of the supporting member 221 is pressed against or combined with a top surface of the first region 2131. A bottom surface of the supporting member 221 is pressed against or combined with a bottom surface of the first region 2131. And a circumferential side surface of the supporting member 221 is pressed against or combined with a circumferential side surface of the first region 2131, thereby firmly wrapping and fixing the supporting member 221 within the first region 2131, avoiding axial or radial movement of the supporting member 221 relative to the carrying plate 211. A part of the structure of an upper portion of the connecting shaft 2221 is wrapped within the second region 2132, and covered by an outer end surface of the first limit member 214. And a circumferential side surface of an upper portion of the connecting shaft 2221 is pressed against or bonded with a circumferential side surface of the second region 2132, thereby firmly wrapping and fixing an upper portion of the connecting shaft 2221 within the second region 2132 and avoiding a radial movement of an upper portion of the connecting shaft 2221 relative to the first limit member 214. A part of the structure of the connecting plate 2223 is wrapped within the third region 2133, and covered by an outer end surface of the second limit member 215. One side surface of the connecting plate 2223 is pressed against or bonded to one side surface of the third region 2133. Another side surface of the connecting plate 2223 is pressed against or bonded to another side surface of the third region 2133. And an end surface of the connecting plate 2223 is pressed against or bonded to an end surface of the third region 2133, thereby firmly wrapping and securing the connecting plate 2223 within the third region 2133, so as to avoid circumferential or radial movement of the connecting plate 2223 relative to the second limit member 215, thereby allowing the connecting structure 22 as a whole to be firmly fixed relative to the carrying structure 21 and not to move relative to the carrying structure 21. In other embodiments, it is further possible to locate all of the structure of an upper portion of the connecting shaft 2221 and the connecting plate 2223 within the wrapping region 213 and covered by an outer end surface of the carrying structure 21; or it is further possible to wrap all of the structure of an upper portion of the connecting shaft 2221 within the second region 2132 and covered by an outer end surface of the first limit member 2141; or it is further possible to wrap all of the structure of the connecting plate 2223 within the third region 2133 and covered by an outer end surface of the second limit member 215, so as to increase the wrapping range and improve the stability of the wrapping fixation.

As shown in FIG. 7, in some specific embodiments, the mounting support component 121 is provided as at least one bearing 1211, conducive to driving the carousel unit 2 in a smoother rotational movement relative to the base unit 1. The diameters of an upper opening 1101, a lower opening 1102 of the mounting channel 110 are smaller than an outer diameter of the bearing 1211, thereby limiting and supporting the bearing 1211 within the mounting channel 110. While the friction force between side walls of the mounting channel 110 and an outer side of the bearing 1211 can support the bearing 1211, more direct and powerful support is provided to a bottom of the bearing 1211 according to a top wall of a lower opening 1102, thereby greatly improving the load carrying capacity of the base unit, and providing more stable support to the rotation shaft 2222 and the carousel unit 2 as a whole, and limiting a bottom of one lower-end bearing 1211 according to a top wall of a lower opening 1102, limiting a top of one upper-end bearing 1211 according to a bottom wall of an upper opening 1101, which allows the mounting and positioning structure of the bearing 1211 more stable, and prevents the bearing 1211 from falling off with respect to the mounting channel 110, thereby avoiding the risk of the child tipping over or slipping off during the rotating process, and improving the safety of the process of using the bearing 1211. The bearing 1211 and the base structure 11 are processed and connected as an integrated structure during production, and the bearing 1211 is firmly wrapped and fixed in the mounting channel 110, so that the bearing 1211 cannot move relative to the mounting channel 110, and the stability and the fastness of the connection between the bearing 1211 and the base structure 11 are improved.

In some specific embodiments, there are three (3) bearings 1211, with a strong support capacity and a load carrying capacity, resulting in a better overall load carrying capacity of the sensory integration carousel for children. And in other embodiments, the bearings 1211 may also be provided as 2 or other numbers. The bearings 1211 are stacked along a height direction of the mounting channel 110. And the bearings 1211 include outer sleeves limited within the mounting channel 110 along a height direction of the mounting channel 110, and inner sleeves rotatably coupled to an inner side of the outer sleeves. Wherein, the inner sleeves are coaxially arranged with the outer sleeves. And centers of the inner sleeves are combined with each other to form the connecting channel 120.

As shown in FIGS. 4 and 7-8, in some specific embodiments, a limit bracket 2224 is formed in an upper part of the rotation shaft 2222 protruding outwardly in its circumferential direction; and a butt joint portion 2225 is provided at a lower end of the rotation shaft 2222 for engagement connecting with a fastening structure 223; and the rotation shaft 2222 is capable to extend from an upper end of the connecting channel 120 into the connecting channel 120 and is limited relative to a height direction of the connecting channel 120 by being clamped between the limit bracket 2224 and the fastening structure 223 by the inner sleeves of the bearings 1211. And when the carousel unit 2 is driven to rotate, inner sleeves of each bearing 1211 is driven to rotate relative to outer sleeves, so as to realize the rotational connection between the carousel unit 2 and the base unit 1, and to avoid the axial movement of the rotational shaft 2222 relative to the connecting channel 120, thereby preventing the carousel unit 2 from axially moving relative to the base unit 1. And the rotation shaft 2222 and the connecting channel 120 are pressed against or combined with each other, thereby preventing the rotation shaft 2222 from moving radially relative to the connecting channel 120, and preventing the carousel unit 2 from moving radially relative to the base unit 1, so as to realize the mounting, positioning and the rotational connection between the carousel unit 2 and the base unit 1, and the structure is simple and the assembly is convenient. In the present embodiment, an outer wall of the limit bracket 2224 has the same radius as an outer wall of an upper part of the connecting shaft 2221; and both are smoothly connected with each other as an integrated structure, simplifying the structure. And in other embodiments, an outer wall of the limit bracket 2224 may also be spaced at an interval from an outer wall of an upper portion of the connecting shaft 2221.

As shown in FIGS. 4 and 7, in some specific embodiments, the fastening structure 223 includes a fastener 2231 and a limit block 2232. The fastener 2231 has a connecting end 22311 and an operating end 22312 connected to the connecting end 22311. The limit block 2232 is connected to the connecting end 22311 and the operating end 22312. And the butt joint portion 2225 is configured as a docking channel formed by recessing from an end surface of the rotation shaft 2222. The connecting end 22311 extends into the docking channel, and is engagement connected with the rotation shaft 2222; and after the connection, an upper side of the limit block 2232 is pressed against a lower side of inner sleeves of one lower-end bearing 1211. A female threaded structure is provided within the docking channel, and a male threaded structure is provided at the connection end 22311. And the fastener 2231 is tightly connected to the rotation shaft 2222 by a threaded fit between the male threaded structure and the female threaded structure, which facilitates installation or disassembly. In the present embodiment, the fastener 2231 and the limit block 2232 are integrally molded, and the structure is simple and practical. And in other embodiments, the limit block 2232 can also be connected only to either of the connection end 22311 or the operation end 22312. And the fastener 2231 and the limit block 2232 can also be disposed as separate independent structures, the fastener 2231 and the limit block 2232 are embedded outside the connecting end 22311 via the limit stop 2232, and are limited on the operating end 22312, for removable connections.

As shown in FIG. 7, in some specific embodiments, the limit bracket 2224 is arranged within an upper opening 1101 of the mounting channel 110, and spaced at an interval from the sidewalls of the upper opening 1101. And the limit block 2232 is arranged in a lower opening 1102 of the mounting channel, and spaced at an interval from the sidewalls of the lower opening 1102. That is, during rotation process of the carousel unit 2 relative to the base unit 1, the limit bracket 2224 does not contact with an upper opening 1101, and the limit block 2232 does not contact with a lower opening 1102 either, thereby reducing friction, and facilitating smooth rotation of the carousel unit 2.

Figure 5:
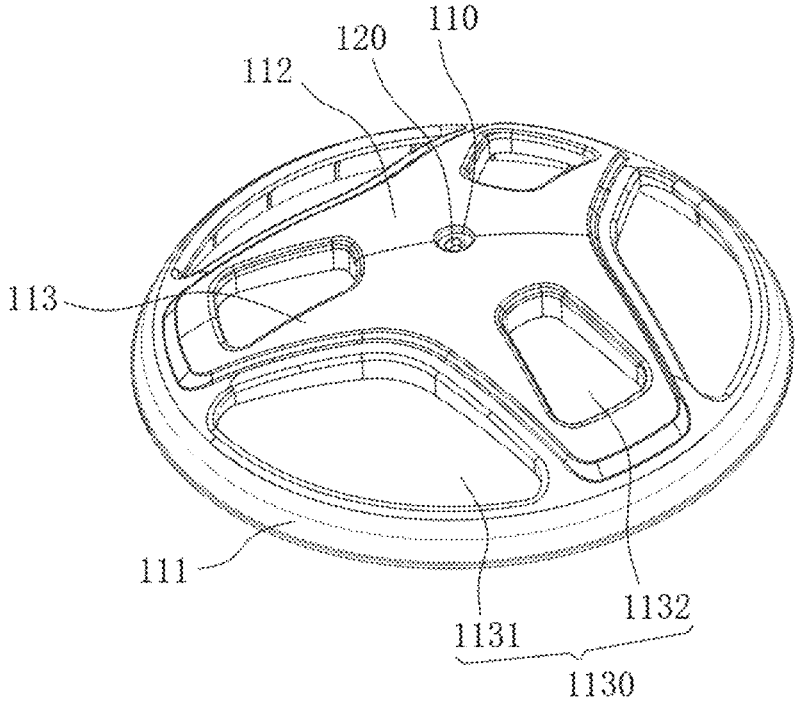
FIG. 5 illustrates a schematic diagram I of a structure of a base unit according to the first embodiment of the present disclosure.
Figure 6:
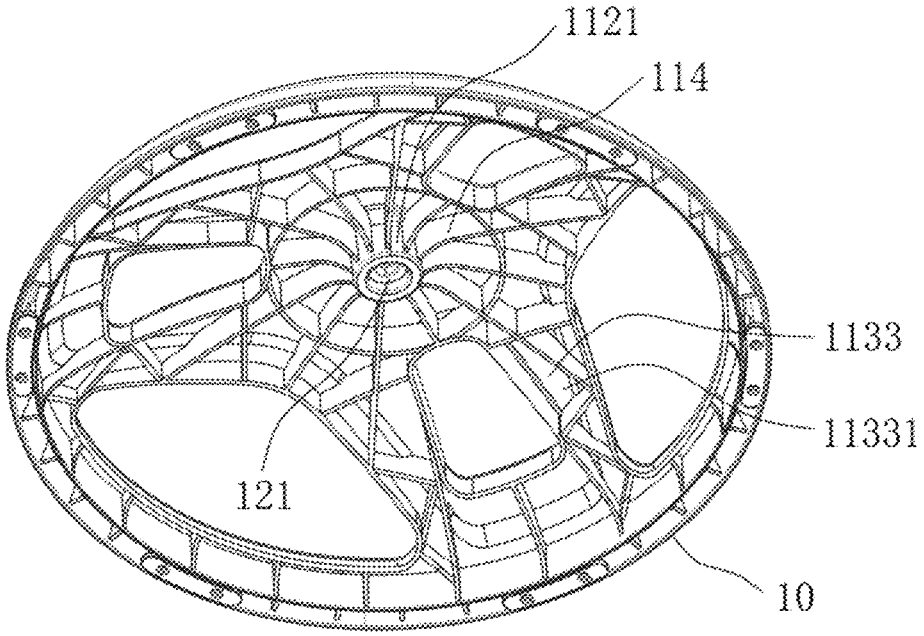
FIG. 6 illustrates a schematic diagram II of the structure of the base unit according to the first embodiment of the present disclosure.

As shown in FIGS. 5-6, 8, in some specific embodiments, the base structure 11 includes a base frame 111 at a bottom of the base structure 11, a mounting plate 112 at a top of the base structure 11, and a base plate 113 arranged along a circumferential direction of the mounting plate 112. An upper end of the base plate 113 is connected to the mounting plate 112 as an integrated structure; and a lower end of the base plate 113 is connected to the base frame 111 as an integrated structure. And the mounting plate 112, the base plate 113 and the base frame 111 are connected in a smooth transition on outer surfaces of the mounting plate 112, and form an arc shaped support structure extending from a top of the mounting plate 112 to a bottom of the base frame 111. The support interface 10 is arranged at a bottom of the base frame 111, and the mounting structure 12 is arranged on the mounting plate 112. The arc shaped support structure is such configured that during rotation of the carousel unit 2, the forces on the various portions of the base unit 1 are relatively uniform, so that the structure is stable and sturdy and is not easily damaged. And the mounting plate 112 is supported at a certain height via the base frame 111 and the base plate 113. And the mounting plate 112 is spaced at an interval in a spaced arrangement with a supporting countertop such as ground, floor surface, in order to form a spherical recessed space capable of placing an object on a lower side of the base structure 11.

As shown in FIG. 6, in some specific embodiments, a number of second support components 114 for providing support force are disposed in each lower part of the base frame 111, the mounting plate 112, and the base plate 113 respectively. The second support components 114 are provided as block-like structures spaced at an interval and linearly protruding along a lower surface of the base frame 111, the mounting plate 112, or the base plate 113. The base structure 11 is made of plastic material, and processed and molded by production processes such as injection molding, and blow molding, so as to facilitate mass production. And the second support components 114 are used to strengthen the structural strength of the base frame 111, the mounting plate 112, and the base plate 113, and to improve the stability and the carrying capacity of the structure of the base structure 11. In other embodiments, it is further possible to provide second support components 114 only on any one or two of the structures of the base frame 111, the mounting plate 112, and the base plate 113; and it is further capable of strengthening the structural strength of the base structure 11 to a certain extent. The base structure 11 can also be made of other materials, such as metal, wood, or the like.

In some specific embodiments, a number of second support components 114 are provided. Wherein each of the second support components 114 includes second support components 114 in a circular structure on a lower surface of the mounting plate 112, and a plurality of second support components 114 in a strip structure and arranged in a clockwise direction with the center of the mounting plate 112. The second support components 114 in circular structure are arranged in coaxial arrangement with the connecting shaft 2221, and the radius of the second support components 114 in circular structure is configured to be greater than a radius of the connecting shaft 2221. A mounting base 1121 extends downwardly from a lower surface of the mounting plate 112 and arranged in correspondence with the mounting channel 110 through a center of the mounting plate 112. The mounting structure 12 is provided on the mounting base 1121. And the connecting shaft 2221, the mounting channel 110, and the mounting base 1121 are all arranged at an angle with the support interface 10, which angle is configured to be greater than 75° and less than 90°, in particular, greater than 80° and less than 90°, which can allow the child to clearly experience the sensation of ascending and descending during the rotation process, while ensuring the safety of the sensory integration training of the child. And the plurality of second support components 114 in a strip-shaped structure are arranged on an inner side of the second support components 114 in the circularly-structure. And one end of each of the plurality of second support components 114 in a strip-shaped structure is combined with the mounting base 1121; and another end of each of the plurality of second support components 114 in a strip-shaped structure is combined with the second support components 114 in the circular structure, thereby making the structure of mounting plate 112 more stable and solid. The second support components 114 on a lower surface of the base plate 113 are arranged in a strip-like structure. And one end of a part of the second support components 114 in the strip-like structure is combined with the second support components 114 in the circular structure on a lower surface of the mounting structure 12. And the other end of a part of the second support components 114 in the strip-like structure is combined with the flange structure on the edge of the plate surface of the base plate 113, making the structure of the base plate 113 more stable and sturdy, and capable of providing direct and strong support for the pressure force exerted on the base structure 11 at various angles when the child rides on the carrying portion 2111, and avoiding breakage of the mounting plate 112 or the base plate 113. The base frame 111 is provided as a double-ring structure combined with each other at an upper end of either ring of the double-ring structure. The second support components 114 on a lower surface of the base frame 111 are provided as a strip structure, and the second support components 114 are arranged in a clockwise direction from the center of the base frame 111. And one end of the second support components 114 is combined with an outer ring of the double-ring structure; and the other end of the second support components 114 is combined with an inner ring of the double-ring structure, so that the structure of the base frame 111 is more stable and sturdy. The support interface 10 is arranged at a bottom of the double-ring structure. And in this embodiment, an anti-slip mat is mounted and arranged within the double-ring structure. And a bottom of the double-ring structure and a bottom surface of the anti-slip mat together form the support interface 10. In other embodiments, an anti-slip mat may also be provided at a bottom of the double-ring structure; a support interface 10 may also be formed entirely from a bottom of the double-ring structure, or be formed entirely from a bottom surface of the anti-slip mat; and the second support components 114 may be provided with other shaped structures such as a curved structure, all of which can be used to strengthen the structural strength of the mounting plate 112.

As shown in FIG. 5, in some specific embodiments, a open-worked structure 1130 is provided on the base plate 113 through the base plate 113 from an outer surface of the base plate 113 to the inner surface of the base plate 113. On the one hand, the open-worked structure 1130 can save materials and production costs; and on the other hand, the open-worked structure 1130 is connected to the spherical recess space formed on a lower side of the base structure 11, and can be used as a storage channel for the spherical recess space.

In some specific embodiments, the open-worked structure 1130 includes a plurality of first open-worked channels 1131 arranged along a circumferential direction of the mounting plate 112. The first open-worked channels 1131 extends from the vicinity of the base frame 111 toward the vicinity of the mounting plate 112. The first open-worked channels 1131 are spaced in a uniform interval. And a base member 1133 is formed between two adjacent first open-worked channels 1131. The base member 1133 is a plate-like structure. An upper end of the base member 1133 is connected to the mounting plate 112 as an integral structure; and a lower end of the base member 1133 is connected to the base frame 111 as an integral structure. In this embodiment, the first open-worked channel 1131 is configured as a fan-shaped structure. And a distance between the two sides of the base member 1133 gradually increases from a lower end of the base member 1133 to an upper end of the base member 1133, so as to maximize the area of the first open-worked channel 1131 while ensuring that the mounting plate 112 is stably supported, more economically saving production costs, and more convenient for a child to place or take objects into/from a spherical recessed space via the first open-worked channel 1131.

In some specific embodiments, the open-worked structure 1130 further includes a plurality of second open-worked channels 1132 arranged along a circumferential direction of the mounting plate 112. The second open-worked channels 1132 extends from the vicinity of the mounting plate 112 towards the vicinity of a lower end of the base member 1133, further saving production costs. A base portion 11331 is formed between two adjacent channels, that is, a first open-worked channel 1131 and a second open-worked channel 1132. An upper end of the base portion 11331 is connected to the mounting plate 112 as an integrated structure, and a lower end of the base portion 11331 is connected to the base frame 111 as an integrated structure.

In some specific embodiments, upper ends of the two base portions 11331 arranged on both sides of the first open-worked channel 1131 are connected with each other via a circular arc surface transition; and lower ends of the two base portions 11331 arranged on both sides of the first open-worked channel 1131 are respectively connected with the base frame 111 via a circular arc surface transition. Compared to being connected via a transition through two intersecting planes, the forces of parts of the structures of the mounting plate 112, the base plate 113, and the base frame 111 are more uniform and less likely to be damaged. And an inner side walls of the first open-worked channel 1131 are more rounded and smooth, and are less likely to scratch a child.

As shown in FIGS. 1-2, 8, in some specific embodiments, the carrying structure 21 is configured as a circular disk structure with a simple structure; and grip channels 2115 are provided respectively on the opposing sides of the carrying plate 211 for the operator's finger to reach into, through the carrying plate 211; and the grip member 2112 is arranged on an outer side of the grip channel 2115, which is convenient for the child to grasp the grip member 2112. The height of the grip member 2112 is higher than the height of the center point of the carrying portion 2111. And the gripping angle is more in line with the structure of the human body, for better comfort.

Figure 9:
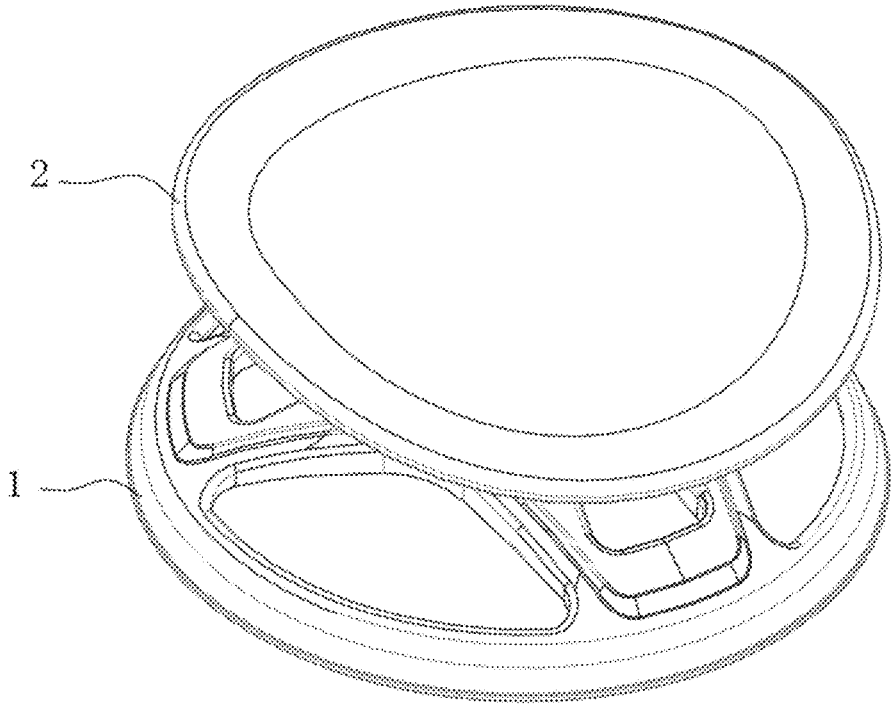
FIG. 9 illustrates a schematic diagram of the structure of the sensory integration carousel for the child according to the second embodiment of the present disclosure.
Figure 10:
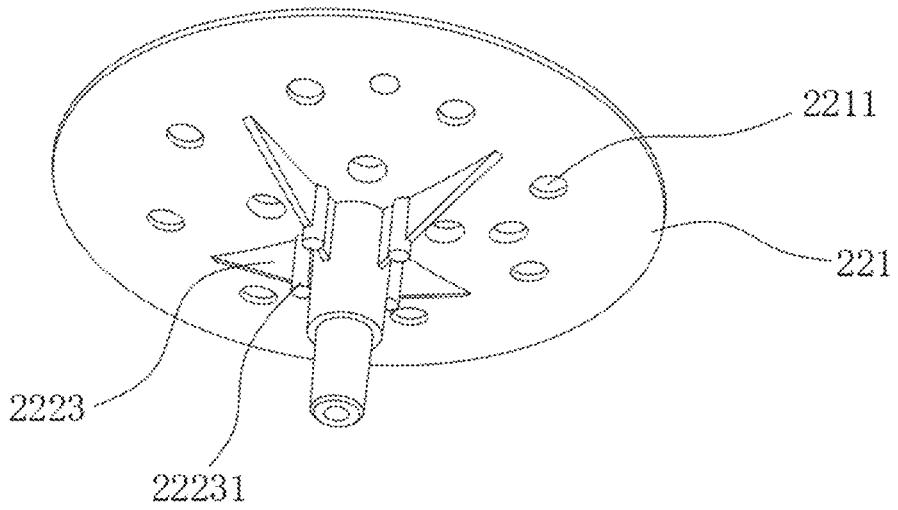
FIG. 10 illustrates a structural schematic diagram of a connecting structure according to the second embodiment of the present disclosure.
Figure 11:
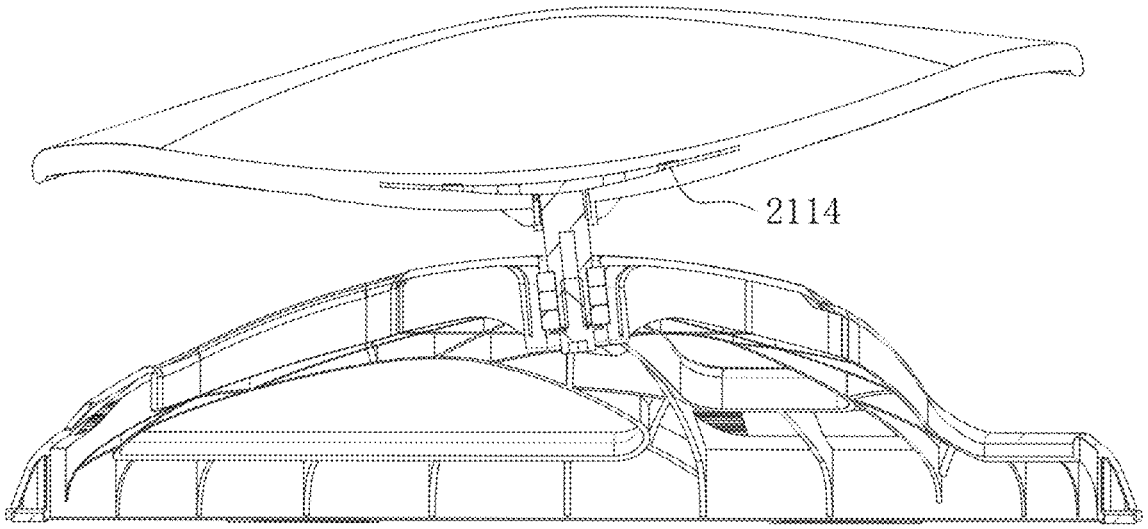
FIG. 11 illustrates a schematic diagram of a cross-sectional structure of the sensory integration carousel for the child according to the second embodiment of the present disclosure.

As shown in FIGS. 9-11, as a second embodiment of the present disclosure, there is also provided a sensory integration carousel for a child. And the main difference of the second embodiment relative to the first embodiment is that: a reinforced column 22231 is further provided on the connecting plate 2223; an upper end of the reinforced column 22231 is connected to a lower surface of the supporting member 221; and the reinforced column 22231 is arranged in parallel with the connecting shaft 2221 for further strengthening the stability and load carrying capacity of the structure of the supporting member 221. A number of positioning channels 2211 are provided on the supporting member 221 across a top surface of the supporting member 221 and a bottom surface of the supporting member 221. And a number of positioning pillars 2114 are provided in the first region 2131 in correspondence with the positioning channels 2211. The positioning pillars 2114 are arranged in the positioning channels 2211, and are pressed against or combined with the positioning channels 2211. An upper end of the positioning pillar 2114 is combined with a top surface of the first region 2131; and a lower end of the positioning pillar 2114 is combined with a bottom surface of the first region 2131, thereby further securely wrapping and fixing the supporting member 221 within the first region 2131, and avoiding circumferential movement of the supporting member 221 with respect to the carrying plate 211.

Figure 12:
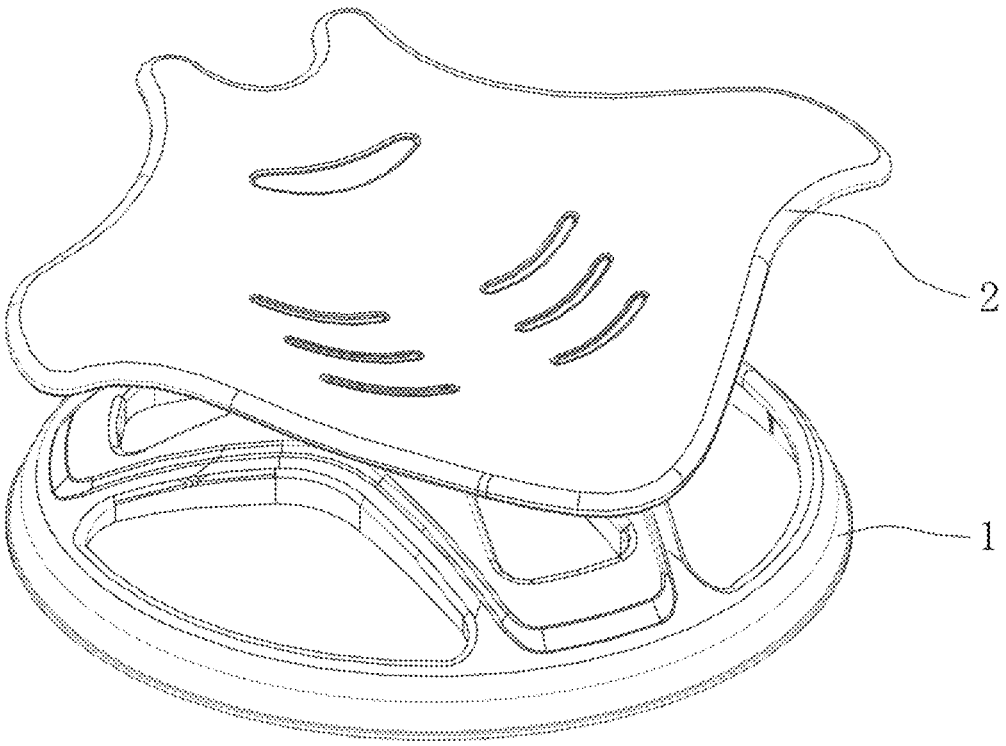
FIG. 12 illustrates a schematic diagram of the structure of the sensory integration carousel for the child according to the third embodiment of the present disclosure.
Figure 13:
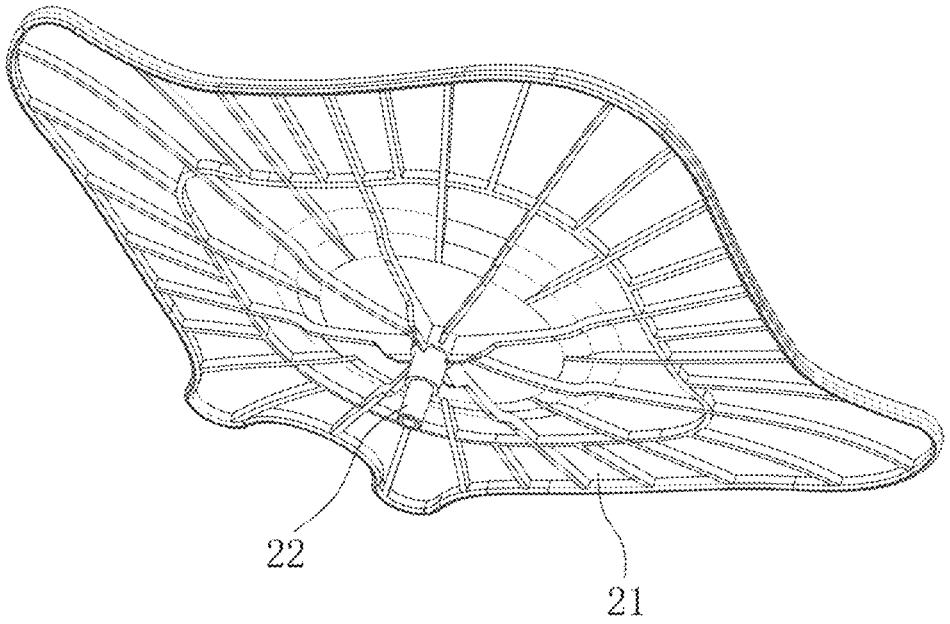
FIG. 13 illustrates a schematic diagram of the structure of the carousel unit according to the third embodiment of the present disclosure.

As shown in FIGS. 12-13, as the third embodiment of the present disclosure, a sensory integration carousel for a child is also provided. The main difference between the third embodiment and the first embodiment is that: the carrying structure 21 is configured as a fish-shaped structure, which is richer in shape and more capable of stimulating the child's interest in sensory integration training. In other embodiments, the carrying structure 21 can also be configured as other animal structures such as a pig, a cow, and a duck, or other animal structures such as triangular, polygonal, and a flower.

In conclusion, the above is only preferred embodiments of the present disclosure, and all equivalent changes and modifications made in accordance with the patent scope of the present disclosure shall be covered by the present disclosure patent.

What is claimed is:

1. A sensory integration carousel for a child, comprising:

a base unit, comprising a base structure for placing on a support countertop surface and a mounting structure provided in an upper part of the base structure, wherein, a support interface is formed at a lower part of the base structure and in a circumferential direction configured to be pressed against the support countertop surface, and an outer surface of the base structure is provided in an arc shape in a direction to a bottom of the base structure from a top of the base structure;

the mounting structure, comprising a mounting channel through the base structure, a mounting support component disposed within the mounting channel, and a connecting channel disposed along a center of the mounting support component and through the base structure;

a carousel unit, comprising a carrying structure and a connecting structure connected to a lower portion of the carrying structure; wherein, the carrying structure is connected with the connecting structure as an integrated structure, and a carrying portion is disposed at an upper portion of the carrying structure for articles to be pressed against and in an arc surface;

the connecting structure, comprising a supporting member that is enclosed by a lower part of the carrying structure and a connecting member connected to the supporting member; wherein, a lower part of the connecting member is disposed as a rotation shaft; and the rotation shaft is embedded in the connecting channel and connected to the base unit; and the carousel unit is arranged at an angle to the support interface of the base unit after the carousel unit is connected to the base unit via the rotation shaft; and the carousel unit is rotatably disposed along an axial direction of the rotation shaft via the rotation shaft relative to the base unit;

a wrapping region is provided in a lower portion of the carrying structure, the supporting member is located within the wrapping region and covered by an outer end face of the carrying structure, which limits the supporting member within the carrying structure along the axial direction of the rotation shaft;

the connecting member comprises a connecting shaft connected to the supporting member, and a rotation shaft integrally formed with a lower portion of the connecting shaft, and a connecting plate protrudes outwardly at an upper part of the connecting shaft and is arranged in a length direction of the connecting shaft, and all or part of a structure of an upper part of the connecting shaft and of the connecting plate are located within the wrapping region and covered by the outer end face of the carrying structure, which is capable of limiting the connecting plate within the carrying structure along a circumferential direction of the rotation shaft;

the supporting member is provided as a panel structure aligned with a longitudinal direction of the carrying portion, and a plurality of connecting plates are arranged at an interval along a circumferential direction of the connecting shaft, and each connecting plate is arranged along a radial direction of the connecting shaft, and connected vertically with a lower surface of the supporting member;

the carrying structure comprises a carrying plate, a first limit member protruding from a lower surface of the carrying plate and disposed adjacent to an upper part of the connecting shaft, and a second limit member protruding from a lower surface of the carrying plate and mounted to the connecting plate; and the wrapping region comprises a first region disposed within a lower structure of the carrying plate, a second region disposed within the first limit member, and a third region disposed within the second limit member; and the supporting member is enclosed by the first region and covered by an outer end surface of the carrying plate, a top surface of the supporting member is attached to a top surface of the first region, a bottom surface of the supporting member is in contact with a bottom surface of the first region, and a circumferential side surface of the supporting member is fitted within a circumferential side surface of the first region; and all or part of a structure of an upper part of the connecting shaft is within the second region and covered by an outer end surface of the first limit member, a circumferential side surface of an upper portion of the connecting shaft is pressed against or bonded with a circumferential side surface of the second region; and at least a portion of the connecting plate is enclosed within the third region and covered by an outer end surface of the second limit member; one side surface of the connecting plate is pressed against or bonded to one side surface of the third region, another side surface of the connecting plate is pressed against or bonded to another side surface of the third region.

2. The sensory integration carousel for the child according to claim 1, wherein: the carrying plate of the carrying structure comprises an upper plate, a lower plate, and a grip member provided on the carrying plate for gripping when the carrying structure is driven to rotate, wherein, the carrying portion is provided as a panel structure formed from an upper surface of the carrying plate in a circumferential direction, and the grip member comprises a portion of an external flange of the carrying portion.

3. The sensory integration carousel for the child according to claim 2, wherein: two or more first support components for providing a support force is provided in a lower portion of the carrying plate, and the two or more first support components are provided as a block-like structure spaced at an interval and arranged linearly along a lower surface of the carrying plate and protruding from a bottom end surface of the carrying plate.

4. The sensory integration carousel for the child according to claim 3, wherein: the two or more first support components are provided as a strip structure or a circular structure or a curved structure.

5. The sensory integration carousel for the child according to claim 3, wherein: the carrying plate has an external flange, and the external flange are provided as bosses distributed along an outer circumference of the carrying plate and formed by extending in a direction toward a bottom of the carrying portion from an upper surface of the carrying portion, and an end of the first support components is bonded to an inner surface of a portion of the external flange of the carrying plate.

6. The sensory integration carousel for the child according to claim 1, wherein: the connecting structure is made of a metallic material, and an upper part of the connecting structure is completely covered by a lower structure of the carrying structure.

7. The sensory integration carousel for the child according to claim 1, wherein: the mounting support component is provided as at least one bearing, and an upper opening, and a lower opening of the mounting channel have a diameter smaller than an outer diameter of the bearing.

8. The sensory integration carousel for the child according to claim 7, wherein: the at least one bearing comprises two or more bearings, and the at least one bearing is stacked along a height direction of the mounting channel; and the at least one bearing comprises an outer sleeves limited in the mounting channel along a height direction of the mounting channel, and an inner sleeves rotatably connected to an inner side of the outer sleeves; wherein the inner sleeves are arranged in coaxial arrangement with the outer sleeves, and centers of the inner sleeves are combined with each other to form the connecting channel.

9. The sensory integration carousel for the child according to claim 8, wherein: a limit bracket is formed in an upper part of the rotation shaft protruding outwardly in its circumferential direction; and a butt joint portion is provided at a lower end of the rotation shaft for engagement connecting with a fastening structure; and the rotation shaft is capable to extend from an upper end of the connecting channel into the connecting channel and is limited relative to a height direction of the connecting channel by being clamped between the limit bracket and the fastening structure by the inner sleeves of the at least one bearing.

10. The sensory integration carousel for the child according to claim 1, wherein: the base structure comprises a base frame at a bottom of the base structure, a mounting plate at a top of the base structure, and a base plate arranged along a circumferential direction of the mounting plate; and an upper end of the base plate is connected to the mounting plate as an integrated structure; a lower end of the base plate is connected to the base frame as an integrated structure; and outer surfaces of the mounting plate, the base plate, and the base frame are connected in a smooth transition, and form an arc support structure extending from a top of the mounting plate to a bottom of the base frame; and the supporting interface is arranged at the bottom of the base frame; and the mounting structure is arranged on the mounting plate.

11. The sensory integration carousel for the child according to claim 10, wherein: two or more second support components for providing a support force are disposed in a lower portion of the base frame and/or the mounting plate and/or the base plate; the two or more second support components are provided in a block-like structure spaced at an interval and linearly protruding along a lower surface of the base frame and/or the mounting plate and/or the base plate.

12. The sensory integration carousel for the child according to claim 10, wherein: a open-worked structure is provided from an outer surface of the base plate to an inner surface of the base plate, through the base plate.

13. The sensory integration carousel for the child according to claim 12, wherein: the open-worked structure comprises a plurality of open-worked channels, wherein the plurality of open-worked channels comprises a first open-worked channel and a second open-worked channel; the first open-worked channels arranged along a circumferential direction of the mounting plate; and the first open-worked channels are arranged extending from a vicinity of the base frame towards a vicinity of the mounting plate; and a base member is formed between two adjacent the first open-worked channels; an upper end of the base member is connected to the mounting plate as an integrated structure; and a lower end of the base member is connected to the base frame as an integrated structure.

14. The sensory integration carousel for the child according to claim 13, wherein: the first open-worked channel is provided in a fan-shaped structure; and a distance between two sides of the base member gradually increases from a lower end of the base member to an upper end of the base member.

15. The sensory integration carousel for the child according to claim 14, wherein: the open-worked structure further comprises a plurality of the second open-worked channels arranged along a circumferential direction of the mounting plate; and the second open-worked channels are arranged extending from a vicinity of the mounting plate towards a vicinity of a lower end of the base member; and a base portion is formed between adjacent channels, comprising the first open-worked channels and the second open-worked channels; an upper end of the base portion is connected to the mounting plate as an integrated structure; and a lower end of the base portion is connected to the base frame as an integrated structure.

16. The sensory integration carousel for the child according to claim 15, wherein: upper ends of two base portions arranged on either side of the first open-worked channel are connected with each other via a circular arc surface transition; and lower ends of the two base portions arranged on either side of the first open-worked channel are connected with each other, and are connected to the base frame respectively, via a circular arc surface transition.

* * * * *